United States Patent [19]

Nosal et al.

[11] Patent Number: 4,538,350

[45] Date of Patent: Sep. 3, 1985

[54] METHOD OF MANUFACTURING A MULTICORE CABLE

[76] Inventors: Vsevolod V. Nosal, Leningradsky prospekt, 74, kv. 205; Jury V. Rybakov, ulitsa Goncharova, 7, kv. 58; Viktor T. Golovkin, Zelenodolskaya ulitsa, 28, korpus 3, kv. 51; Mikhail M. Novokreschenov, ulitsa Lobachevskogo, 78, kv. 47; Boris V. Lysikov, Universitetsky prospekt, 21, korpus 1, kv. 8; Anatoly V. Staneshin, Ryazansky prospekt, 97, kv. 44, all of, Moscow, U.S.S.R.

[21] Appl. No.: 391,300

[22] Filed: Jun. 24, 1982

[51] Int. Cl.[3] ..... H01R 43/00

[52] U.S. Cl. ..... 29/825; 29/517

[58] Field of Search ..... 29/825, 517; 72/202; 156/52, 53, 54

[56] References Cited

U.S. PATENT DOCUMENTS 3,693,250 9/1972 Brorein et al. ..... 29/825
4,214,693 7/1980 Smith ..... 29/517 X

FOREIGN PATENT DOCUMENTS 131284 2/1949 Australia ..... 29/517
2059304 4/1981 United Kingdom ..... 29/825

*Primary Examiner*—Howard N. Goldberg
*Assistant Examiner*—Carl J. Arbes
*Attorney, Agent, or Firm*—Steinberg & Raskin

[57] ABSTRACT

The disclosed method of manufacturing a multicore cable with insulation, particularly, for sensing elements of communication lines, includes assembling a blank of a cable, deforming the blank of a cable by rolling between two rolls with smooth variation of the degree of reduction over the length of the working stroke from 0 to 90 percent, each successive reduction being conducted at an angle up to 90° relative to the preceding one, and annealing the blank of a cable following each deformation. There are also disclosed two embodiments of the apparatus for performing the method of making a multicore cable, of which the first one is adapted for rolling the blank of a cable from the diameter of 18.0 mm to the diameter of 3.0 mm in two passes, while the other embodiment is adapted for rolling the cable from the diameter of 3.0 mm to the diameter of 1.0 mm in one pass.

5 Claims, 4 Drawing Figures

METHOD OF MANUFACTURING A MULTICORE CABLE

FIELD OF THE INVENTION

The present invention relates to the manufacture of a multicore cable, and more particularly it relates to a method of making a multicore cable and to apparatus capable of performing such method.

INDUSTRIAL APPLICABILITY

The present invention can be employed to utmost effectiveness in the nuclear and electrical engineering industries, and also in various technical fields which require utilization of a cable operable under the action of elevated temperatures, aggressive fluids and vibrations.

BACKGROUND OF THE INVENTION

Thermoelectric sensing elements made of a special-design multicore cable with insulation find ever wider applications.

Substantial advantages offered by such thermoelectric sensing elements or transducers reside mainly in the fact that they make it possible to have the minimum diameter of for example, 1.00 mm in the area of location of the hot junction (to enhance the measurement accuracy), which diameter is then increased to 3.00 mm in a smooth transition over a 50 mm length (to reduce the impedance of the measurement circuit). This enables to do without specific adaptors between the cables of different diameters and makes sensing elements of this type by far the best for such applications as the active zone of nuclear reactors and other apparatus with elevated temperatures.

There is known a method of rolling small-diameter tubes (cf. SU Inventor's Certificate No. 296,603; Int. Cl. B 21 b 13/18, dated Dec. 14, 1970), comprising the following steps.

The rolling of the tubes is effected by three rollers accommodated in a specific cage and having their journals bearing upon profiled supporting strips.

The latter are mounted in a holder mounted, in its turn, in the bearing assemblies of a carriage of a welded structure, provided with a mechanism for rotating it, while the cage of the rollers is connected to the drive through a bearing unit of which the axis is aligned with the axis of the tube being rolled.

The mechanism for rotating the holder is made as a driven splined shaft with pinions mounted thereon.

In the rolling operation, the carriage is reciprocated jointly with the supporting strips mounted therein. The drive reciprocating the carriage is essentially a crank mechanism, the carriage being connected with the link arm through a rod of an adjustable length.

As the carriage is reciprocated, the link arm is driven through a rocking motion about its stationary axis. The points of connection of the rod of the cage and of the carriage to the link arm are so situated that the linear speed of the cage and the amount of its displacement along the axis of rolling are one half of those of the carriage.

When the stand is driven through the working stroke, the rollers have their journals bearing upon the inclined surfaces of the supporting strips, providing for bringing the rollers simultaneously together by the value of the predetermined difference between the heights.

The groove of the roller corresponds to the selected size of the tubes to be rolled and has its own size permanent over the entire perimeter.

When the size of tubes to be rolled is changed, the rollers are replaced and the leverage of the rolling stand is readjusted.

A tube is fed in when the stand occupies the rearmost position in the rolling direction. Simultaneously, the rotation mechanism of the rolling-stand is operated to rotate the rotatable holder and the cage with the rollers, the holder being rotated by the torque transmitted by the driven splined shaft through the pinions.

However, this known method is not free from drawbacks.

The single-pass deformation amounts to but 6 to 10 percent. This is explained by the fact that tubes are rolled by the rollers having the permanent cross-section of their grooves, so that 15 passes are required to roll tubes of the 1.0 mm diameter from 3.0 mm blanks.

With a single set of the working rollers being fit for rolling tubes of one diameter only, in the abovedescribed case 15 sets of working rollers would have been required.

The manufacture of the working tooling for rolling tubes of diameters short of 3.0 mm has proved to be so technologically complicated that the method being described has been deemed impractical both for rolling tubes and making a multicore electric cable.

There is commonly known a method of making a multicore cable by the drawing technique, including the following steps.

The leading end of a multicore cable 15 to 25 meter long (depending on the further application of the cable), coiled into a coil 400 to 500 mm in diameter, is prepared for being clamped in a drawing gripper, and then the necessary length of the leading end portion is drawn successively through a series of drawing dies to a diameter of 2.6 mm. Then the processed length of the cable is annealed (to relieve the strain) in a furnace filled with argon (the shielding gas) at 800° C. to 1000° C. for 15 minutes. The same furnace is used for annealing simultaneously several blanks of the cable being processed.

Following the annealing, the cable is subjected to similar drawing to the diameter of 2.32 mm and to another annealing operation.

Then the cable is drawn to the diameter of 1.8 mm, annealed, and drawn once again to the diameter of 1.6 mm, whereafter the gripped end is cut off, and the cable is annealed once again.

The reduction of the multicore cable from the 3.00 mm diameter to the 1.6 mm diameter is effected in 23 passes, with the outer diameter of the cable reduced by 0.06 mm during each pass, with four intervening annealing operations.

The drawing of the cable from the 1.6 mm diameter to the diameter of 1.0 mm is conducted in a similar manner, the only difference being that the total reduction of the cable is achieved in 30 passes, with the outer diameter of the cable being reduced by 0.02 mm in each pass. Then the gripped end is cut off.

Thus, the generally used technique of making an electric cable by drawing from the 3.0 mm diameter to the 1.0 mm one involves 53 passes and 8 intervening annealing operations.

A drawback of the known method is that the respective technology of making a multicore cable with the diameter varying along its length is very labor-consuming.

Moreover, the predominant action of axial forces in the deformation area in the course of drawing creates the least favorable conditions for deforming the metal, results in significantly quicker strain hardening and tends to leave bottleneck portions and to increase the breakage rate of the metal being deformed.

For this reason the drawing technology necessitates the considerable amount of passes with a small degree of deformation and intervening annealing stages intended to relieve the strain in the metal.

Quite obviously, this technology badly affects the general productivity in the fabrication of a multicore cable, to say nothing of its necessitating an increased amount of the production plant and of its operators.

There is known a method of making a multicore cable by rotary swaging or reduction (cf. V. F. Sutchkov, V. I. Svetlov, E. E. Finkel, "Heat-Resistant Cables with Magnesia Insulation", ENERGIYA Publishers, Moscow, 1969, p. 19) including the following stages.

The shape of the blank is changed by reduction in rotary swaging machines by a working member rotated about the blank and having a tool operatively connected with a mechanical drive and a reciprocation mechanism.

The blank in the reduction zone is acted upon by external compressing forces transmitted via the strikers, which causes its deformation, with the cross-section of the blank being reduced and the metal moving axially of the blank.

The accuracy and finish attained by working articles by the rotary swaging technique is greatly dependent on the manufacturing quality of the tools—the strikers, on the rigidity, the assembling quality and the adjustment of the rotary swaging mechanism.

Assuming that the abovedescribed combination of the factors is satisfactory, the machine is capable of producing a multicore cable of the 1.0 mm diameter from a blank 3.0 mm in diameter in a single pass, with the surface complying with "9" to "10" Finish Class (standard deviation of profile roughness $R_z$ of 0.16 to 0.32) and "2" to "3" Accuracy Class (tolerance $J_s$ from 10 microns to 24 microns).

However, notwithstanding the attainable high surface finish and accuracy class, a drawback of this method is that swaging in machines with revolving working tools—the strikers—results in substantial twisting of the article being worked.

The existing designs of mechanisms of rotary swaging machines do not provide for reducing the blank simultaneously over its entire contour. Therefore, the metal being deformed is allowed to flow into gaps between the strikers, i.e. the pattern allows for deformation with expansion.

This factor curbs down the rate of feeding the metal to be deformed into the deformation zone, and, therefore, puts a limit to the throughput of the machine.

The throughput of the operation of rotary swaging could be increased by stepping up the number of individual compressions per unit of time, but this would lead to increased noise, vibration, rapid failure of the components and tools, more frequent maintenance and repairs of the machine, and even to emergency situations.

SUMMARY OF THE INVENTION

It is an object of the present invention to substantially enhance the quality of a multicore cable being made.

It is another object of the present invention to increase the throughput of the operation of making a multicore cable.

These and other objects are attained in a method of manufacturing a multicore cable with insulation, comprising the steps of assembling a blank of the cable and subjecting it to deformation with intervening annealing, in which method, in accordance with the invention, the deformation of the blank is effected by rolling between two rolls, with smooth variation of the degree of reduction over the length of the working stroke from 0 to 90 percent, each successive reduction being conducted at an angle up to 90° relative to the preceding reduction.

Furthermore, the objects of the present invention are attained in an apparatus for performing the method of making a multicore cable with insulation, comprising a working unit with a tool operatively connected with a mechanical drive and a reciprocation mechanism, in which apparatus, in accordance with the invention, the working unit includes a rolling-stand accommodating therein two rolls with grooves of a varying profile, for conducting the rolling with smooth variation of the degree of reduction over the length of the working stroke from 0 to 90 percent, each roll having its own drive for matching the profiles of the rolls in the deformation zone.

The objects of the present invention are attained in an apparatus for performing the method of making a multicore cable, comprising a working unit with a tool operatively connected with a mechanical drive and a reciprocation mechanism, in which apparatus, in accordance with the invention, the working unit is in the form of a rotatable rolling-stand accommodating therein two rolls with grooves of a varying profile, for conducting the rolling with smooth variation of the degree of reduction over the length of the working stroke from 0 to 90 percent, each roll having its own drive for matching the profiles of the rolls in the deformation zone.

The disclosed method of making a multicore cable and the apparatus for performing this method provide for a high productivity and reduced cost of manufacturing a multicore cable, owing to the significantly reduced number of passes and thermal treatment operations.

SUMMARY OF THE DRAWINGS

The invention will be further described in connection with embodiments thereof, with reference being made to the appended drawings, wherein.

DETAILED DESCRIPTION OF THE INVENTION

The method of making a cable with insulation of a diameter of 3.0 mm is performed, as follows.

Initially, there is assembled a blank for the cable including the steps of taking a tube 20 mm in diameter, made of corrosion-resistant steel, and placing there tablets of magnesium oxide, with apertures for wires of such alloys as chromium-nickel (Chromel-type), aluminum-nickel (Alumel-type), or cadmium-nickel, or else periclase powder is poured in.

A blank thus assembled is subjected to preliminary reduction in a drawbench to a 18.0 mm diameter, followed by recurrent rolling in two passes to a 3.0 mm diameter in an apparatus providing for varying smoothly the reduction degree over the length of the working stroke from 0 to 90 percent, each successive reduction being conducted at an angle up to 90° relative to the preceding reduction.

The essence of this method will be described in more detail hereinbelow, as part of the discussion of the apparatus for performing this method in making a multicore cable of a 3.0 mm diameter.

Figure 1:
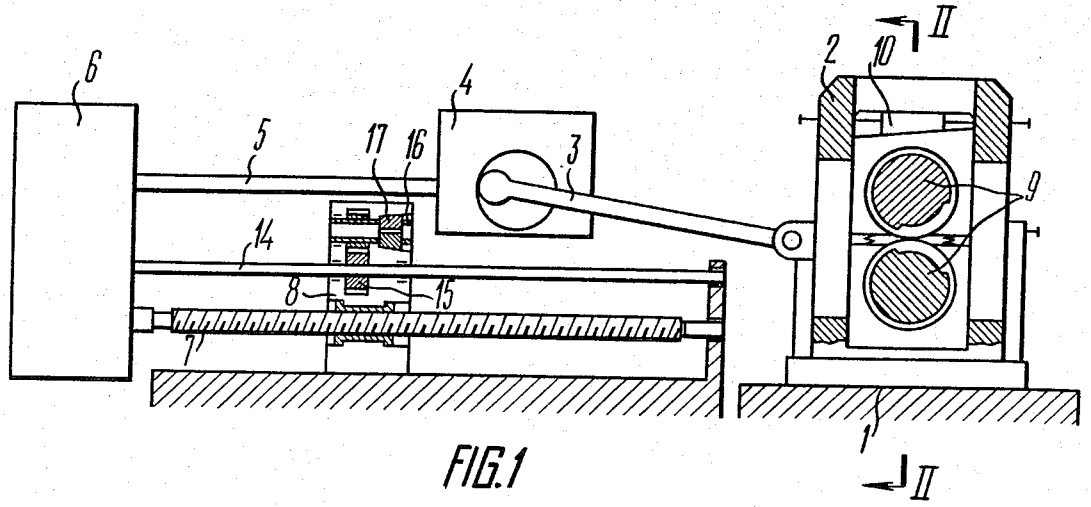
FIG. 1 shows schematically an apparatus for rolling a multicore cable to a 3.0 mm diameter, embodying the invention.
Figure 2:
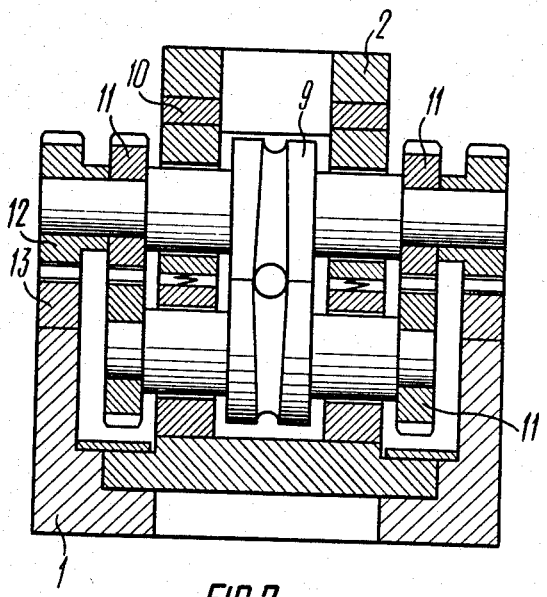
FIG. 2 is a sectional view taken on line II—II of FIG. 1.

The apparatus for performing the method of making a multicore cable of a diameter up to 3.0 mm, embodying the invention, comprises a bed 1 (FIGS. 1 and 2) having mounted thereon the movable housing 2 of the rolling-stand connected by a connecting-rod 3 with a reciprocation mechanism 4.

The reciprocation mechanism 4 is operatively connected via a transmission shaft 5 to a feed and rotation mechanism 6, and via a feed screw 7 to the chuck 8 for a blank.

The housing 2 of the rolling-stand is a monolithic box-shaped structure accommodating the working rolls 9, with a mechanism 10 for setting the spacing of the rolls accommodated above the rolls 9.

The working rolls 9 have two sets of grooves at their opposite sides, each groove being of a variable profile for cable-rolling.

One set of the grooves of the working rolls 9 is intended for rolling the cable from a 18.0 mm diameter to a 7.0 mm diameter, while the other set is intended for rolling from the 7.0 mm diameter to a 3.0 mm diameter.

Timed rotation of the working rolls 9 is ensured by driven gears 11 (FIG. 2) operatively connected with each other.

The rotation of the working rolls 9 during the working stroke of the housing 2 of the rolling-stand is provided for by pinions 12 rolling in engagement with stationary toothed racks 13.

Rotation of the blank being rolled is effected by the feed and rotation mechanism 6 (FIG. 1) through the rotating shaft 14, a gear couple 15 and a spindle 16 accommodating the cams for clamping the blank of the multicore cable being rolled.

The apparatus operates as follows.

With the rolling-stand in the rearmost position, the feed and rotation mechanism 6 is operated to rotate the spindle 16 with the cams 17 and, consequently, with the cable being rolled, through 57°, at the same time feeding the blank of the cable by the predetermined distance.

The rotation of the reciprocation mechanism 4 results in the housing 2 of the rolling-stand being displaced in the rolling direction by the value of two radii of the crank, i.e. through a full stroke of the rolling-stand.

The pinions 12 roll in engagement with the toothed racks 13 (FIG. 2), effecting timed rotation of the working rolls 9 in the direction of their smaller radius, thus ensuring that the blank of the cable is rolled from the 18.0 mm diameter to the 7.0 mm one, with the degree of reduction of the cable blank being smoothly varied over the length of the working stroke from 0 percent to 85 percent, each successive reduction being conducted at an angle of 57° relative to the preceding one.

Upon the cable having been rolled to the 7.0 mm diameter, it is annealed in an argon-filled furnace for 15 minutes at 800° C. to 1000° C.

To roll the cable from the 7.0 mm diameter to the 3.0 mm diameter, the roll changeover is performed in the rolling-stand, conducted as follows.

The driving pinions 12 are disengaged from the toothed racks 13 and replaced by ones with a greater pitch circle, to match the rolling diameter-to-be, and the working rolls 9 are turned through 180°, whereafter the new driving pinions 12 are engaged with the toothed racks 13.

Then the rolling of the cable from the 7.0 mm diameter to the 3.0 mm one is performed in the manner similar to the rolling from the 18.0 mm diameter to the 7.0 mm diameter.

Following the rolling, the coiled cable 3.0 mm in diameter is once again annealed for 10 minutes.

With the cable of the 3.0 mm diameter having been rolled, the rolling-stand is once again subjected to a roll changeover. The driving pinions 12 are disengaged from the toothed racks 13 and replaced by the pinions of the smaller pitch circle, to match the rolling diameter, and the rolls are turned through 180°, whereafter the pinions 12 are engaged with the racks 13.

This changeover prepares the rolling-stand once again for rolling the cable from the 18.0 mm diameter to the 7.0 mm one.

The disclosed method provides for recurrent longitudinal rolling of a multicore cable from the 18.0 mm diameter to the 3.0 mm diameter in two passes in the rolls of the varying rolling profile, with one intervening annealing operation.

The rolling of the cable to the 1.0 mm diameter is performed in another apparatus where the blank 3.0 mm in diameter is fed by predetermined lengths into the deformation zone between two rolls having the varying profile of their rolling pass.

The rolling of the cable is conducted with smooth variation of the degree of reduction over the length of the working stroke from 0 to 90 percent, each successive reduction being conducted at an angle of 90° relative to the preceding one.

The essence of this modification of the method in accordance with the present invention will be described in more detail in connection with the description of the apparatus for performing this method of making a multicore cable.

The apparatus for performing the method of making a multicore cable in accordance with the invention comprises a bed 18 on which four casters 19 support a reciprocable all-welded carriage 20 operatively connected by a connecting-rod 21 to a reciprocation mechanism 22.

The carriage 20 is operatively connected through a gear couple 23 and a splined shaft 24 to a feed and rotation mechanism 25.

The carriage 20 has journalled therein in antifriction bearings 26 a thick-wall sleeve 27 and a cam lid 28. The thick-wall sleeve 27 has mounted thereon in a cantilever fashion a rolling-stand 29 which is of a monolithic box-shaped structure accommodating two working rolls 30, with a mechanism 31 for controlling the spacing of the rolls 30 and a mechanism 32 for adjusting to the rolling size of the multicore cable being accommodated in the rolling-stand 29 to the diametrically opposing sides of the rolls 30.

The working rolls 30 have their rolling pass of a varying profile, with the radius of the rounding of the corners at the external surface not in excess of 0.3 mm.

Figure 3:
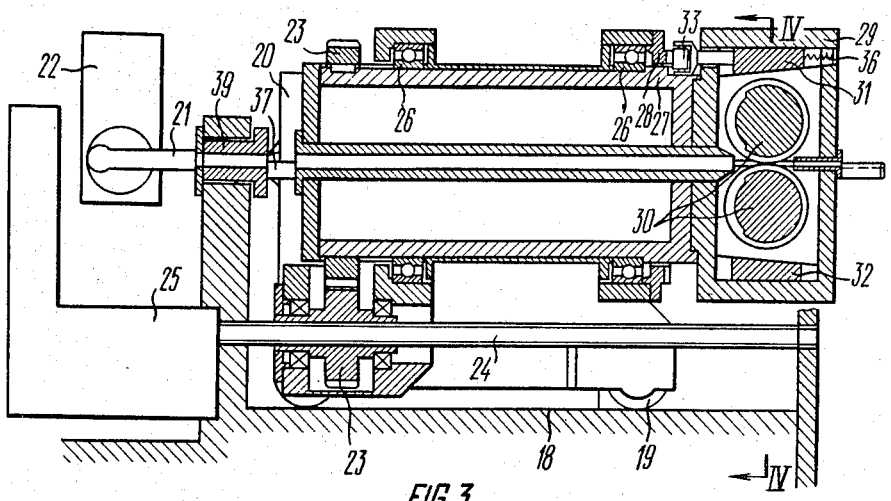
FIG. 3 is a sectional view of an apparatus for rolling a multicore cable to a 1.0 mm diameter, embodying the invention.
Figure 4:
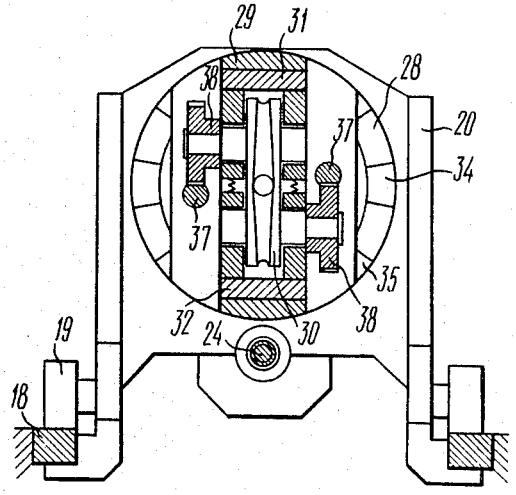
FIG. 4 is a sectional view taken on line IV—IV of FIG. 3.

The mechanism 31 controlling the spacing of the rolls 30 includes a follower 33 (FIG. 3) which is kept in permanent engagement with the cam face of the cam lid 28 (FIGS. 3 and 4).

The cam face surface of the cam lid 28, facing the rolling-stand 29, has four projecting lands 34 (FIG. 4) and four recessed lands 35, alternating at 45°.

Each recessed land 35 has a permanent depth with gradual ascent and descent to the adjoining projecting land 34, thus defining the predetermined degree of the variation of the spacing of the rolls 30.

The follower 33 (FIG. 3) is held in permanent engagement with the cam face of the cam lid 28 by the effort of a spring 36 acting upon the opposite side of the mechanism 31 controlling the spacing of the working rolls 30.

The rotation of the rolling-stand 29 relative to the cable being rolled is effected by the feed and rotation mechanism 25 through the splined shaft 24 and the gear couple 23.

Two toothed racks 37 (FIG. 3) run at the sides of the rolling-stand 29.

Throughout the working stroke of the rolling-stand 29, the rotation of the working rolls 30 is ensured by the pinions 38 rolling in engagement with these toothed racks 37. The racks 37 have their remote free ends secured against axial displacement in a spindle 39.

The apparatus of this embodiment operates, as follows.

In the initial endmost position of the rolling-stand 29 the feed and rotation mechanism 25 rotates the thick-wall sleeve 27 and, hence, the rolling-stand 29 relative to the cable to be rolled through 45°, feeding at the same time the cable through the predetermined length.

Owing to this rotation, the follower 33 of the mechanism 31 controlling the spacing of the rolls 30 rolls in engagement with the projecting land 34 of the cam lid 28, driving the mechanism 31 in the rolling sense, i.e. to reduce the spacing of the rolls 30.

Then the reciprocation mechanism 22 is rotated to drive the carriage 20 on the casters 19 in the rolling direction by the distance equalling two radii of the crank, i.e. through the full working stroke of the rolling-stand 29.

The pinions 38 roll in engagement with the toothed racks 37 and rotate the working rolls 30 synchronously in the direction of their smaller radii, thus providing for deformation of the cable with smooth variation of the degree of reduction over the length of the working stroke from 0 percent to 90 percent, each successive reduction being effected at an angle of 90° relative to the preceding reduction.

With the carriage 20 driven to its rearmost position, the rolling-stand 29 is rotated once again through 45°.

In this case the follower 33 of the mechanism 31 controlling the spacing of the rolls 30 engages the recessed land 35 of the cam lid 28 under the action of the spring 36, whereby the mechanism 31 spreads the working rolls 30.

Thus, the rotation of the rolling-stand 29 at the two endmost positions is effected by the feed and rotation mechanism 25 via the splined shaft 24 and the gear couple 23 through the total angle of 90°.

As the operative connections of the apparatus are such that the feed is combined with the rotation, the double stroke of the rolling-stand 29 is accompanied by a double feed of the cable blank.

With the rolling-stand 29 being driven through its return stroke, the rack-and-pinion engagement rotates the rolls 30 into their initial position, and then the follower 33 rolls onto the successive projecting land 34 of the cam lid 28, and the cycle of rolling the cable blank is repeated.

The last-described embodiment of the apparatus performs recurrent longitudinal rolling of a multicore cable from the 3.0 mm diameter to the 1.0 mm one in a single pass between the rolls of the varying rolling profile, so that single-pass reduction by 90 percent is attained.

Thus, the manufacture of a multicore cable by the method of recurrent profile rolling by the rolls with the varying profile of their grooves from the 18.0 mm diameter to the 1.0 mm diameter in three passes enables to step up the productivity of reducing the number of the passes and intervening thermal treatment operations required, while also enabling to have less production plant and to bring down the manufacturing cost of the final product.

What is claimed is:

1. A method of manufacturing a multicore cable with insulation, particularly for sensing elements of communication lines, comprising the steps of:

assembling a blank of a cable;

deforming said blank of a cable from a diameter of about 18.0 mm to a diameter of about 3.0 mm in two successive reductions by rolling said blank between two rolls of varying profile over the perimeters thereof to smoothly vary the degree of reduction over the length of the working stroke from 0 to 90 percent, and rotating said blank prior to each successive reduction at an angle up to 90° relative to the preceding reduction; and annealing said blank of a cable following each reduction.

2. The method of claim 1, comprising deforming said blank from a diameter of about 18.0 mm. to about 7.0 mm. in the first reduction, and from about 7.0 mm. to about 3.0 mm. in the second reduction.

3. The method of claim 1, comprising deforming said blank from a diameter of about 3.0 mm. to a diameter of about 1.0 mm. in a single further reduction.

4. The method of claim 2, comprising rolling said blank between two rolls of varying profile over the perimeters thereof to smoothly vary the degree of reduction over the length of the working stroke from 0 to 85 percent, and rotating said blank prior to each successive reduction at an angle of about 57° relative to the preceding reduction.

5. The method of claim 4, comprising annealing said blank at a temperature from 800° to 1000° C. after deforming said blank to a diameter of about 7.0 mm.

* * * * *